United States Patent [19]

Rickey

[11] Patent Number: 4,926,734

[45] Date of Patent: May 22, 1990

[54] GRAPHIC/TACTILE MUSICAL KEYBOARD AND NOMOGRAPHIC MUSIC NOTATION

[76] Inventor: James C. Rickey, 16000 NE. 4th, Bellevue, Wash. 98008

[21] Appl. No.: 236,459

[22] Filed: Aug. 25, 1988

Related U.S. Application Data

[63] Continuation-in-part of Ser. No. 59,606, Jun. 5, 1987, abandoned, which is a continuation-in-part of Ser. No. 827,515, Feb. 10, 1986, abandoned.

[51] Int. Cl.[5] ..... G10C 3/12

[52] U.S. Cl. ..... 84/423 R; 84/424; 84/428

[58] Field of Search ..... 84/423, 424, 427, 428

[56] References Cited

U.S. PATENT DOCUMENTS

| | | | |
|---|---|---|---|
| 152,726 | 7/1874 | Cramer | 84/428 |
| 161,806 | 4/1875 | McChesney | 84/428 |
| 301,577 | 7/1884 | Drew | 283/47 |
| 334,484 | 1/1886 | Stewart | 84/428 |
| 360,255 | 3/1887 | Von Janko | 84/428 |
| 532,964 | 1/1895 | Ingraham | 84/485 X |
| 682,014 | 9/1901 | Adams | 84/428 |
| 682,015 | 9/1901 | Adams | 283/47 |
| 888,100 | 5/1908 | Kuba | 84/427 |
| 1,009,194 | 11/1911 | Smith | 84/423 R |
| 1,009,671 | 11/1911 | Kraft | 283/47 |
| 1,200,361 | 10/1916 | Kinney | 283/47 |
| 1,202,882 | 10/1916 | Nordbo | 84/428 |
| 1,313,015 | 8/1919 | Reeve | 283/47 |
| 1,473,495 | 11/1923 | Miller | 283/47 |
| 1,483,380 | 2/1924 | Reeve | 283/47 |
| 1,539,308 | 5/1925 | Faunt | 283/47 |
| 1,594,194 | 7/1926 | Burgess | 283/47 |
| 1,958,227 | 5/1934 | Barnett | 84/423 A |
| 2,003,894 | 6/1935 | Leudtke | 84/423 B |
| 2,061,364 | 11/1936 | Leudtke | 84/423 B |
| 2,203,393 | 6/1940 | Reuther | 84/428 |
| 2,406,946 | 9/1946 | Firestone | 84/423 R |
| 2,417,639 | 3/1947 | Firestone | 84/428 |
| 2,611,291 | 9/1952 | Heim | 84/427 |
| 2,701,498 | 2/1955 | Koch et al. | 84/423 B |
| 2,706,926 | 4/1955 | Young | 84/451 |
| 3,022,698 | 2/1962 | Lucas | 84/423 A |
| 3,111,056 | 11/1963 | Weigl | 84/425 |
| 3,141,371 | 4/1965 | Coles . | |
| 3,199,396 | 8/1965 | Winch | 84/423 R |
| 3,331,271 | 7/1967 | Glenn | 84/478 |
| 3,339,447 | 9/1967 | Currey et al. | 84/478 |
| 3,342,094 | 9/1967 | Wilson | 84/423 B |

FOREIGN PATENT DOCUMENTS

| | | | |
|---|---|---|---|
| 238511 | 4/1911 | Fed. Rep. of Germany . | |
| 3404 | of 1811 | United Kingdom | 84/428 |
| 709 | of 1853 | United Kingdom | 84/423 R |
| 6647 | of 1907 | United Kingdom | 84/423 R |
| 345183 | 3/1931 | United Kingdom | 84/423 B |
| 2131592A | 6/1984 | United Kingdom . | |

*Primary Examiner*—Lawrence R. Franklin

*Attorney, Agent, or Firm*—Graybeal, Jensen & Puntigam

[57] ABSTRACT

A graphic/tactile musical instruction system includes a three-row equal temperament whole tone graphic/tactile keyboard and a nomographic system of music notation. In a first embodiment of the keyboard, an upper row of keys produces the notes $C^{\#}/D_b$, $D^{\#}/E_b$, F, G, A and B, with the $C^{\#}/D_b$ and $D^{\#}/E_b$ keys being extended forward. The upper row keys are narrower in the highest octaves. The middle row produces the notes C, D, E, $F^{\#}/G_b$, $G^{\#}/A_b$ and $A^{\#}/B_b$, with the $F^{\#}/G_b$, $G^{\#}/A_b$, and $A^{\#}/B_b$ keys extended forward. The lower row keys are aligned with and play the same notes as the upper row keys. In a second embodiment of the keyboard, the upper row keys are narrower in the upper octaves. The F and G upper row keys have raised top surfaces, extended and beveled front ends, and darkened surfaces. The middle row C keys have extended and beveled front ends, raised top surfaces, and darkened surfaces. The lower row F and G keys are raised and darkened.

The nomographic notation is correlated to the keyboard by nomographically marking the lines and spaces of the stave adjacent the key signature and similarly graphically marking the notes played on the upper or lower row with a diagonal slant "\".

18 Claims, 2 Drawing Sheets

10
12
14
16
18
18'
18''
20
22
24a
24b
24c
26
26'
28
30
32a
32b
32c
34
36
38
40
C
C#
D
D#
E
F
F#
G
G#
A
A#
B
C
C#
D
D#
E
F
F#
G
G#
A
A#
B
C

GRAPHIC/TACTILE MUSICAL KEYBOARD AND NOMOGRAPHIC MUSIC NOTATION

CROSS-REFERENCE TO RELATED APPLICATIONS

This application is a continuation-in-part of U.S. patent application Ser. No. 07/059,606, filed June 5, 1987, and entitled Graphic/Tactile Musical Keyboard and Notation which is in turn a continuation-in-part of U.S. patent application Ser. No. 06/827,515, filed February 10, 1986, and entitled Graphic/Tactile Musical Keyboard and Notation, both of said applications being now abandoned.

BACKGROUND OF THE INVENTION

1. Technical Field

This invention relates to musical keyboards and notation systems, and more particularly to a graphic/tactile musical instruction system having a graphic/tactile, symmetrical three-row twelve note whole tone musical keyboard and a nomographic system of music notation.

2. Description of the Prior Art

The conventional twelve tone musical keyboard comprises two rows of keys. A row of white keys, all of equal width and length in the area in which they are struck by the player, is positioned relatively nearer to the player, and a row of black keys, again of equal width and length but narrower and shorter than the white keys, is positioned relatively farther away from the player and interposed between adjacent white keys. Each octaval grouping contains eight white keys: C, D, E, F, G, A, B and C, and five black keys: $C^{\#}/D_{\flat}$, $D^{\#}/E_{\flat}$, $F^{\#}/G_{\flat}$, $G^{\#}/A_{\flat}$ and $A^{\#}/B_{\flat}$. The black keys are interposed respectively between the white key pairs: C-D, D-E, F-G, G-A and A-B.

The conventional keyboard is asymmetrical, in that adjacent keys in the same row are not always separated to the same musical degree. In the white row, C, D and E are separated from each other by a whole tone, but the white key pairs E-F and B-C are separated by only a half-tone. In the black row, $F^{\#}/G_{\flat}$, $G^{\#}/A_{\flat}$ and $A^{\#}/B_{\flat}$ are separated by a whole tone, but the black key pairs $D^{\#}/E_{\flat}$-$F^{\#}/G_{\flat}$ and $A^{\#}/B_{\flat}$-$C^{\#}/D_{\flat}$ are separated by one and a half-tones (a minor third).

This configuration of the conventional keyboard requires the player to memorize a unique fingering for each scale of each of the twelve key signatures. For example, the C major scale (consisting of the notes C, D, E, F, G, A, B and C) is played entirely on the white keys. The F major scale, which has one flatted key ($B_{\flat}$) in its notes (F, G, A, $B_{\flat}$, C, D, E and F) requires one move to the row of black keys, and an immediate return to the white keys. The $A_{\flat}$ major scale ($A_{\flat}$, $B_{\flat}$, C, $D_{\flat}$, $E_{\flat}$, F, G and $A_{\flat}$) begins with two black keys ($A_{\flat}$ and $B_{\flat}$), then moves to the white keys for one note (C), returns to the black keys for two notes ($D_{\flat}$ and $E_{\flat}$), moves again to the white keys for two more notes (F and G), and ends back on a black key ($A_{\flat}$). This asymmetry of the conventional keyboard, and the resulting irregular fingering sequences, has been the object of much inventive effort.

Twelve note whole tone alternate keyboards have been offered as the answer to various difficulties created by the asymmetry of the conventional keyboard. Whole tone keyboards are arranged so that adjacent keys in a single row are separated by a musical whole tone and adjacent keys in adjacent rows are separated by a half-tone. McChesney U.S. Pat. No. 161,806 discloses a three-row whole tone keyboard where the keys of the first and third rows play the same notes. The keys of the McChesney keyboard are all uniform in size and shape in order to render the touch more uniform, secure and certain. Firestone U.S. Pat. No. 2,406,946 discloses two different whole tone keyboard configurations. A first keyboard has two rows of keys: a rearward row of six black keys, and a forward row of six white keys. A second keyboard is very similar to McChesney, having three-rows of uniformly sized keys with the first and third rows playing the same notes. These keyboards are used in conjunction with a completely rewritten system of music notation, varying the shapes of the bodies of the notes, and utilizing a new system of octave clefs having no accidental markings (sharps "#" and flats "$\flat$"). Firestone U.S. Pat. No. 2,417,639 discloses a modified three-or four-row whole tone keyboard wherein the upper rows of keys are narrowed to facilitate certain fingering maneuvers.

The fingering advantages of the whole tone keyboard are only achieved when three or more rows of keys are provided. On a conventional three-row whole tone keyboard, those six of the twelve major scales beginning on notes in the middle row (C, D, E, $F^{\#}/G_{\flat}$, $G^{\#}/A_{\flat}$ and $A^{\#}/B_{\flat}$) are played using a single sequence of three keys in the middle row, followed by four keys in the upper row, and ending back on the middle row. Thus a C major scale begins with three keys in the middle row (C, D and E), followed by four keys in the upper row (F, G, A and B), and ends on the middle row (C). An $A_{\flat}$ major scale, which required four transitions between the black and white keys on the conventional keyboard, uses the same fingering sequence as the C scale on the graphic/tactile keyboard, beginning with three keys in the middle row ($A_{\flat}$, $B_{\flat}$ and C), followed by four keys in the upper row ($D_{\flat}$, $E_{\flat}$, F and G), and ending back in the middle row ($A_{\flat}$). U.S. Pat. No. 2,406,946 blackens all of the keys of a single row, visually emulating the conventional keyboard. Adams U.S. Pat. No. 682,014 blackens adjacent groups of three keys in a single row and offsets said groups from similar groups in adjacent rows. Stewart U.S. Pat. No. 334,484 blackens and corrugates the tops of those keys in a flattened three-row whole tone keyboard which correspond to the conventional black notes. In Barlow U.K. Patent No. 6,647 (1906) the keys of a two row whole tone keyboard which correspond to the conventional black notes are lengthened when they are located in the upper row of keys, and are blackened when they appear in the lower row. None of the keyboard marking schemes which rely on color are capable of providing a tactile cue regarding keyboard position. Corrugation of the key surfaces certainly provides a tactile cue, but unfortunately slows the player's transitions to and from such corrugated keys, by increasing the resistance to movement of the fingers across the key surfaces. None of the tactile marking schemes simultaneously provide an effective tactile cue of keyboard position and of the presence of the notes played by the cued keys as black keys on the conventional keyboard.

"Improved" systems of music notation are easily as common as "improved" keyboards, and infinitely more varied and complex. Most such improvements begin by supplanting all or part of the conventional system of notation, at one stroke restricting the player to music annotated using the improved system. Barlow U.K.

Patent No. 6,647 (1906), Adams U.S. Pat. No. 682,014, and Firestone U.S. Pat. No. 2,406,946 teach various such "improvements" on the conventional system of notation. No prior art notation system provides a simple yet effective indication of the row of a whole tone keyboard in which lies the key to be struck for each note, without completely supplanting the conventional system of notation with "improved" clefs, notes or other markings.

SUMMARY OF THE INVENTION

The present invention resides in a twelve tone graphic/tactile musical instruction system comprising tone producing means, a graphic/tactile keyboard, and correlated with a nomographic music notation system. Actuation of any two adjacent keys within a single row of the keyboard causes the tone producing means to produce two musical notes separated by a whole tone, and actuation of any two adjoining keys in adjacent rows produces two musical notes separated by a half-tone. The keyboard has an upper row of keys positioned relatively farther away from the player, a middle row of keys, and a lower row of keys positioned relatively closer to the player. The upper row keys produce the notes C♯/D♭, D♯/E♭, F, G, A and B. Adjacent upper row keys are separated by a varying gap with narrower keys in the upper octaves. Selected upper row keys are graphically differentiated, and the same or selected other upper row keys are tactilely differentiated, from the remaining upper row keys. The middle row keys produce the notes C, D, E, F♯/G♭, G♯/A♭ and A♯/B♭. A longitudinal centerline of each middle row key is parallel to and laterally offset from the longitudinal centerline of an adjoining upper row key.

The middle row keys have a uniform width approximately equal to the width of any selected one of the upper row keys plus the width of the gap separating the upper row key from an adjacent upper row key. Selected middle row keys are graphically differentiated, and the same or selected other middle row keys are tactilely differentiated from the remaining middle row keys. The longitudinal centerline of each lower row key is aligned with the longitudinal centerline of a corresponding upper row key which produces the same note as the lower row key. The lower row keys have a uniform width equal to the uniform width of the middle row keys. The front ends of all said lower row keys are coplanar. The nomographic music notation system comprises conventional musical notation key signatures, with the addition of nomographic marking of lines and spaces to be played on one row of the keyboard, while leaving lines and spaces to be played on another row of the keyboard unmarked.

Other features and advantages of the present invention will become apparent from the following detailed description of a typical embodiment thereof, taken in conjunction with the accompanying drawings.

DETAILED DESCRIPTION OF THE PREFERRED EMBODIMENTS

The nomographic music notation system.

The musical instruction system of the present invention includes a graphic system of musical notation including a nomograph which provides the player with a visual indication on the written music of the keyboard location of each note to be played. Although presently applied to a three-row whole tone keyboard, the nomographic system of notation can be readily adapted to other keyboard configurations.

Figures 1, 2:
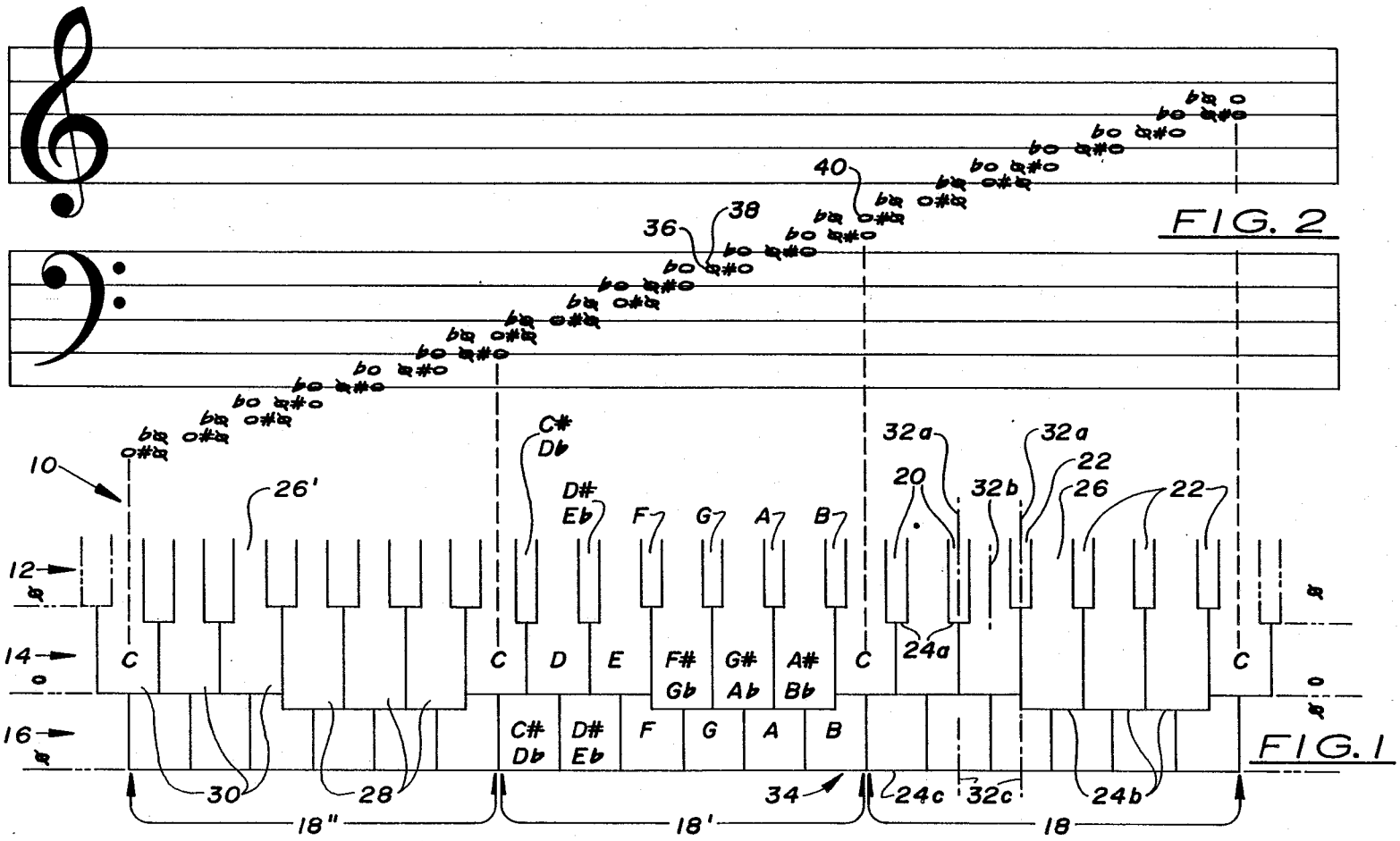
FIG. 1 is a plan view of a first embodiment of the three-row whole tone graphic/tactile keyboard of the present invention, showing two octaval groupings below middle C and one octaval grouping octave above middle C, and showing the extended keys corresponding to the conventional black keys, and the narrowed upper row keys of an upper octaval grouping.
FIG. 2 shows an enharmonic note index, aligned with the keys of the keyboard of FIG. 1, written using some of the nomographic notation of the present invention.

As seen in FIG. 1, a three-row whole tone graphic/-tactile keyboard 10 according to the present invention is symmetrical, in that pairs of adjacent keys in each row are always separated by one whole tone, and the intervening half steps are always played on an adjoining row of keys. There are three-rows of keys: an upper row 12 farthest from the player, a middle row 14 at an intermediate distance from the player, and a lower row 16 closest to the player. The upper row 12 contains keys playing the notes C♯/D♭, D♯/E♭, F, G, A and B. The middle row 14 contains keys playing the notes C, D, E, F♯/G♭, G♯/A♭ and A♯/B♭. The lower row 16 contains keys aligned with and playing the same notes as the keys of the upper row 12. The keys are grouped into octaval groupings 18, 18′, 18″ which include six adjacent middle row keys: C, D, E, F♯/G♭, G♯/A♯ and A♯/B♭, and six upper and six lower row keys: C♯/D♭, D♯/E♭, F, G, A and B. By common musical convention, the keyboard 10 contains a plurality of octaval groupings 18, 18′, 18″ plus a terminating middle row key of C natural following the highest octaval grouping, so that the keyboard begins and ends with a key of C natural. The physical lengths of the octaval groupings are held constant across the entire length of the keyboard, in order to maximize the player's facility on the keyboard.

Each octaval grouping 18, 18′, 18″ on the tactile keyboard of the invention includes six keys in the upper row. Two upper row keys 20 in each octaval grouping 18, 18′, 18″, playing the notes C♯/D♭ and D♯/E♭, are lengthened to simultaneously graphically and tactilely differentiate them from the remaining upper row keys. This differentiation provides the player with graphic and tactile keyboard position cues, and simultaneously remind the player that those keys appear on the conventional keyboard as black keys. This keyboard position cue allows the beginning player to rapidly develop that tactile sense of keyboard position which is a prerequisite to advanced keyboard study, without necessitating or encouraging visual reference to the keyboard. The extending of the extended upper row keys 20 is accomplished by extending the front vertical end surfaces **24*a*** of said keys toward the player by a predetermined distance. The four shorter upper row keys 22 play the notes F, G, A and B, which are produced on the conventional keyboard by white keys.

The widths of the upper row keys can be held constant, or they can be increased or decreased in one or more of the lowest octaval groupings 18' in order to improve the keyboard's fingering facility, thus extending the range of the instrument of which the keyboard is a part. As presently preferred, the keys of the upper row 12 in the upper octaval groupings 18, 18' are narrowed to approximately one-half the width of the gap 26 separating adjacent upper row keys in said upper octaval groupings, while in the lowest one or two octaval groupings 18" the upper row keys have a width approximately equal to the width of the gap 26' separating adjacent upper row keys in said lowest octaval grouping(s).

The middle row 14 contains keys which play notes which are separated by a half-tone from the notes played on adjoining keys of the upper row 12, thus ensuring that the graphic/tactile keyboard is a true whole tone keyboard. Three extended, lengthened keys in each octaval grouping of the middle row 14, which play the notes $F^{\#}/G_{\flat}$, $G^{\#}/A_{\flat}$ and $A^{\#}/B_{\flat}$, provide the player with simultaneous graphic and tactile keyboard position cues, and remind the player that those keys appear on the conventional keyboard as black keys. This keyboard position cue, which is produced in the same manner as the tactile cue provided by the lengthened upper row keys 20, ensures that the player will receive a tactile keyboard position cue regardless of whether the player is playing on the upper and middle rows 12, 14 or the middle and lower rows 14, 16. As in the upper row 12, the extending of the extended middle row keys 28 is accomplished by extending the front vertical end surfaces **24*b* of said lengthened middle row keys toward the player by a predetermined distance. The three shorter middle row keys 30** play the notes C, D and E, which are produced on the conventional keyboard by white keys.

The keys of the middle row 14 are laterally offset from the keys of the upper row 12 such that a longitudinal centerline **32*b* of each middle row key is parallel to the longitudinal centerline 32*a*** of the two adjacent upper row keys and laterally offset perpendicularly therefrom by one half the distance between the centerlines of said upper row keys.

All of the keys of the middle row 14 are equally wide, having a width equal to the width of a single key of the upper row 12 plus the width of the gap 26 separating said upper row key from an adjacent upper row key. In the upper octaval groupings 18, 18' where the width of one of the keys of the upper row 12 is approximately one half the width of the gap 26 between two adjacent upper row keys, the keys of the middle row 14 will be approximately three times as wide as the upper row keys. Where the width of the keys of the upper row 12 is equal to the width of the gap 26' between two adjacent upper row keys, as in the one or two lowest octaval groupings 18", the keys of the middle row 14 will be only twice as wide as the upper row keys.

Each key of the lower row 16 corresponds to a key of the upper row 12 which plays the same note. Corresponding keys of the upper row 12 and lower row 16 are aligned, allowing such corresponding keys to share a unitary operating mechanism (not shown). The longitudinal centerline **32*c* of each key of the lower row 16 lies in the vertical plane containing the longitudinal centerline 32*a* of the corresponding key of the upper row 12. Thus, the keys of both the upper row 12 and lower row 16 are laterally offset from the keys of the middle row 14 such that the longitudinal centerline 32*b* of each middle row key is parallel to the longitudinal centerlines of the four adjacent upper and lower row keys 32*a*, 32*c*** and laterally offset perpendicularly therefrom by one half the distance between the centerlines of said upper and lower row keys.

The keys of the lower row 16 are not extended, allowing the front vertical end surfaces **24*c* of the keys of the lower row 16 to form a coplanar vertical edge surface 34 facing the player. The keys of the lower row 16 have the same width as the keys of the middle row 14**.

As best seen in FIG. 2, the nomographic system of notation marks selected notes 36 with a diagonal slant "/" 38, indicating that the key to be struck is located on the upper row 12 or lower row 16 of the three-row whole tone graphic/tactile keyboard 10. Unmarked notes 40 are played on the middle row 14. It is of course possible to reverse the markings of the notes, leaving the notes to be played on the upper row 12 or the lower row 16 unmarked, and marking the notes to be played on the middle row 14 with a diagonal slant "/". It is also possible to mark the marked notes 36 with a graphic mark other than a diagonal slant "/", although the diagonal slant "/" is preferred for reasons of clarity and simplicity.

Figure 3:
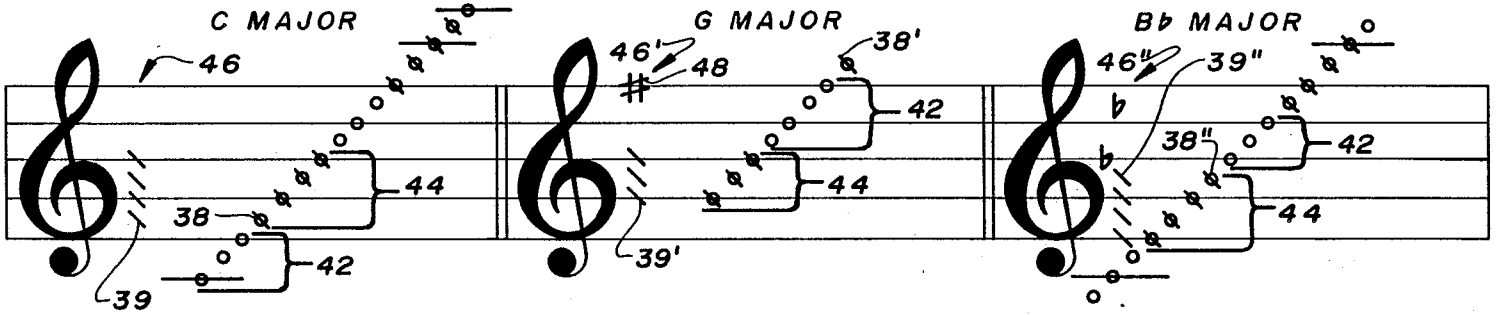
FIG. 3 shows C major, G major and B♭ major scales written in the treble clef using the nomographic notation of FIG. 2 and also the nomographic symbols included in the key signature in accordance with the present invention.

FIG. 3 shows three major scales written in the treble clef using the nomographic notation of the present invention. A two-octave C major scale is shown at the far left of FIG. 3. Ascending from middle C, the first three notes 42 in the C major scale are C, D and E, which are played on the middle row 14 (or 114 as in FIG. 4) of the three-row, whole tone keyboard 10 (or 110 as in FIG. 4). According to the notation system as described above, these notes 42 are left unmarked. Following these first three notes 42 are four notes 44 (F, G, A and B) which are played on the upper row 12 (or 112) or lower row 16 (or 116) of the keyboard 10 (or 110), and which are accordingly graphically marked with a diagonal slant. The second octave of the scale repeats this pattern of three unmarked notes followed by four marked notes, terminating with a final C note. Specifically, notes 44 played on the upper row 12 (or 112) or lower row 16 (or 116) of the keyboard 10 (or 110) are marked with the diagonal slant "/", as at 38. The key signature 46, signifying the key in which the music is scored, is also nomographically augmented. Nomographic augmenting the key signature 46 as well the notes 44 further aids the novice player in locating the correct finger key for a given note in the musical score. To further enhance the readability of the written music, the arrangement of nomographic markings signifying the key of C major is added between the clef sign and the notation, as at 39.

A one-octave G major scale is shown in the center of FIG. 3. The key of G major includes one sharp sign $F^{\#}$, and the conventional key signature 46' for G major places a sharp sign "#" 48 on the uppermost line of the treble clef stave to indicate that notes on that line must be raised a half-step, from F to $F^{\#}$. The notation system of the present invention augments the conventional notation by adding diagonal slants "/", as at 38', to those notes to be played on the upper row 12 (or 112) or lower row 16 (or 116) of the keyboard 10 (or 110). The key of G major comprises the notes G, A, B, C, D, E, F# and G. Of these notes, G, A and B are played on the upper row 12 (or 112) or lower row 16 (or 116) of the keyboard 10 (or 110). Also, according to the invention, in the key signature 46' the second and third lines from the bottom of the treble clef stave, together with the space therebetween, are marked with the slant "/", as at 39'. The key signature 46' and the nomographic marking 39' thereof cooperate to clearly indicate which keys are to be struck. The sharp sign "#" of the key signature 46', placed on the line corresponding to the note F, indicates the note is to be raised a half-tone to F#. At the same time, the lack of a diagonal slant on that line indicates that F# is played on the middle row 14 (or 114) of the keyboard 10 (or 110). Together, the key signature 46' and the nomographic markings 39' fully inform the player of how and where the score of music is to be played.

A two octave B♭ major scale is shown at the far right of FIG. 3. The B♭ major scale includes the notes B♭, C, D, E♭, F, G, A and B♭, of which B♭, C, and D are played on the middle row 14 of the keyboard 10 (or 110), and E♭, F, G and A are played on the upper row 12 (or 112) or lower row 16 (or 116). Therefore in the B♭ key signature 46'', the first and second lines from the bottom of the treble clef stave, together with the spaces immediately above said lines, are marked with the nomographic slant "/", as at 39''. In the key signature for B♭46'', the flat symbols "♭" on the line corresponding to the note B and on the space corresponding to E signify that those notes are to be lowered a half-step to B♭ and E♭ respectively, and the respective absence and presence of the diagonal slant "/" 38'' indicate that those notes are to be played on the middle and upper/lower rows, respectively. Again, the key signature 46'' and the nomographic markings 38'', 39'' together fully inform the player of how and where the scored music is to be played.

As can be seen, this nomographic notation system helps the player to locate and strike the correct key without visual reference to the keyboard, i.e. without requiring the player to look from the music to the keys. This is extremely beneficial to the novice keyboard player's development of that tactile sense of keyboard position which is essential to the achievement of an advanced level of skill.

A significant feature of this invention lies in its ease of application to existing, conventionally scored music. The diagonal slants "/" (e.g., 38) through the notes and adjacent the key signature (e.g., 46, at 39) can be added manually, without requiring the score to be reprinted. This feature immediately distinguishes it from the "improved" notation systems which replace some or all of the conventional clefs, measures, notes, accidentals and phrasing marks. With my nomographic system of notation, the complete range of printed music is made more intelligible and thus more playable.

The preferred, second embodiment of the graphic/tactile keyboard

Figure 4:
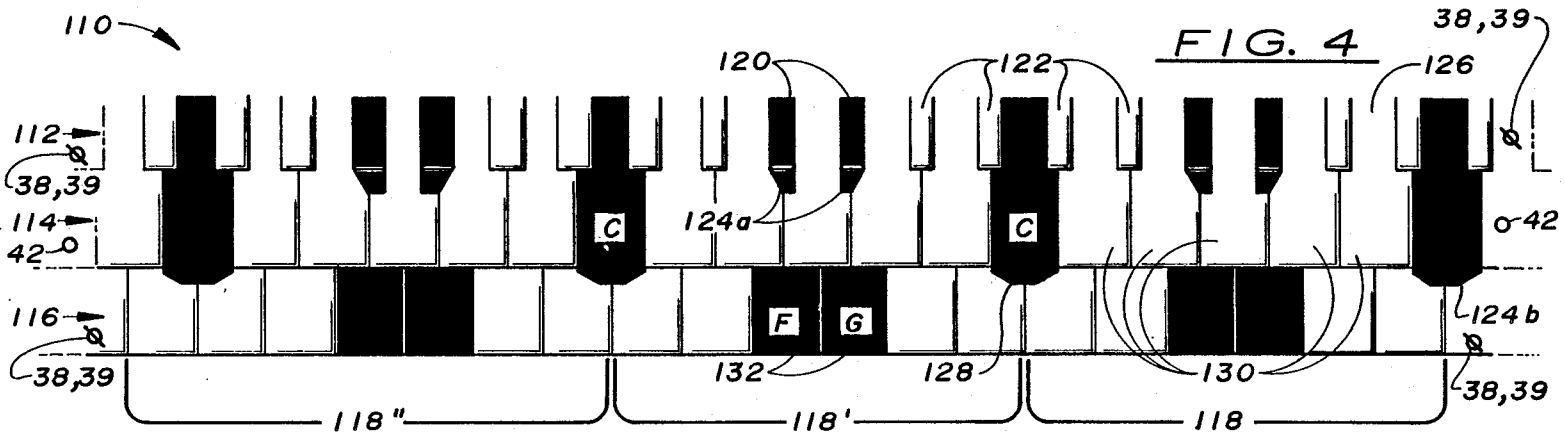
FIG. 4 is a plan view of a preferred, second embodiment of a three-row whole tone graphic/tactile keyboard according to the present invention, showing the major scale index keys darkened, extended and raised upper row F and G keys and middle row C keys, and the darkened and raised lower row F and G keys.

FIG. 4 shows a second graphic/tactile keyboard 110 according the present invention. Like the first embodiment of the keyboard 10, the second keyboard 110 comprises an upper row of keys 112 farthest from the player, a middle row 114 at an intermediate distance from the player, and a lower row 116 closest to the player. The keys of the second keyboard 110 play the same notes as corresponding keys of the first keyboard 10.

The F and G keys 120 in each octaval grouping 118, 118', 118'' of the upper row 112 provide the player with graphic and tactile cues of his or her position on the keyboard. Unlike the first keyboard 10, the marked keys 120 of the second keyboard 110 do not correlate with the black keys of the conventional keyboard, but rather correlate with the second lines of the grand staff above and below middle C, i.e., the G line of the treble clef and the F line of the bass clef. The upper row F and G keys 120 are graphically and tactilely differentiated from the remaining upper row keys 122 by extending and bevelling the vertical surfaces of their front ends **124*a* toward the player by about one eighth inch (⅛"), by raising their top and front surfaces about one eighth inch (⅛"), and by bevelling the top surface and a selected side surface at the front end 124*a* of each marked key. Preferably, opposing side surfaces of the marked keys 120 are beveled, such as the left side of the F key and the right side of the G key adjacent said F key. As in the first keyboard 10, the upper row keys in the upper octaval groupings 118 of the second keyboard are preferably narrower than the upper row keys in the lower octaval groupings 118', 118'', creating wider gaps 126 between the upper row keys in the upper octaval groupings 118**.

In the middle row 114 of the second keyboard 110, the C keys 128 are graphically and tactilely differentiated from the other middle row keys 130 to provide the player with a keyboard position cue in the middle row.

The C keys 128 are tactilely marked by extending and bevelling their front ends **124*b* toward the player about one-eighth inch (⅛") and also by raising their top surfaces about one-eighth inch (⅛"). The C keys 128 are graphically marked by darkening their top and front surfaces. The keys of the middle row 114 are laterally offset from the keys of the upper row 112. All of the keys of the middle row 114** are equally wide.

Like the upper row 112, the F and G keys 132 of the lower row 116 are graphically and tactilely marked by darkening their top and front surfaces and raising the top surfaces about ⅛". No keys of the lower row 116 are extended because a player playing on the middle and lower rows 114, 116 will receive a tactile position cue from the extended C keys 128 of the middle row.

A significant feature of the present invention, and particularly the keyboards thereof, is that it provides a readily understandable indexing arrangement for major scale key signatures. The keyboard such as in FIG. 4 tactilely identifies the three major scales F, C and G, and provides what may be termed an F-C-G Major Scale Index. This major scale index relates to the odd or even number of key signature symbols as found in the order of flats and sharps. C is the basic tone for even flat key signature symbols and tones below C descending by whole steps, and C is also the basic tone for sharp key signature key symbols and tones above C by ascending whole tone steps and the monographic tonic symbol therefore is notation without a given nomographic markings, at 42 in FIGS. 3 and 4. Thus,

| | | | | | | | | |
|---|---|---|---|---|---|---|---|---|
| | $G_b$ | $A_b$ | $B_b$ | $\boxed{C}$ | D | E | $F^{\#}$ | |
| 0 | $6_b$ | $4_b$ | $2_b$ | # | $2^{\#}$ | $4^{\#}$ | $6^{\#}$ | 0 |

The tone F is the basis for odd flat key signature symbols and tonics below F, descending by whole steps, and the nomographic tonic symbol is the graphic notation characteristic of the invention as at 38, 39. Thus,

| | | | | | |
|---|---|---|---|---|---|
| | $C_b$ | $D_b$ | $E_b$ | $\boxed{F}$ | |
| 0 | | | | | $\flat$ |
| | $7_b$ | $5_b$ | $3_b$ | $1_b$ | |

The tone G is the basis for odd sharp key signature symbols and tonics above G, ascending by whole steps, and the nomographic tonic symbol therefore is also the graphic notation characteristic of the invention, as at 38, 39. Thus,

| | | | | | |
|---|---|---|---|---|---|
| | $\boxed{G}$ | A | B | $C^\#$ | |
| 0 | | | | | $\flat$ |
| | $1^\#$ | $3^\#$ | $5^\#$ | $7^\#$ | |

It will be appreciated that, although specific embodiments of the invention have been described herein for purposes of illustration, various modifications may be made without departing from the spirit and scope of the invention. Accordingly, the scope of the invention is not limited except as by the following claims.

I claim:

1. A graphic/tactile musical instruction system, comprising:

tone producing means for producing a musical note in response to the actuation of a selected key of a keyboard;

a graphic/tactile keyboard wherein actuation of any two adjacent keys within a single row causes the tone producing means to produce two musical notes separated by a whole tone, and actuation of any two adjoining keys in adjacent rows produces two musical notes separated by a half-tone, the keyboard having:

an upper row of keys positioned relatively farther away from the player, the upper row keys producing the notes $C^\#/D_\flat$, $D^\#/E_\flat$, F, G, A and B, wherein adjacent upper row keys are separated by a gap, and wherein selected upper row keys are graphically and tactilely differentiated from the remaining upper row keys, the upper row keys in a predetermined one or more highest octaval groupings being narrower than the upper row keys in octaval groupings below said narrower keys;

a middle row of keys positioned lower and relatively closer to the player than the upper row, the middle row keys producing the notes C, D, E, $F^\#/G_\flat$, $G^\#/A_\flat$ and $A^\#/B_\flat$, wherein a longitudinal centerline of each middle row key is parallel to and laterally offset from the longitudinal centerline of an adjacent upper row key, and wherein the middle row keys have a uniform width approximately equal to the width of any selected one of the upper row keys plus the width of the gap separating the upper row key from an adjacent upper row key, and wherein selected middle row keys are graphically and tactilely differentiated from the remaining middle row keys; and a lower row of keys positioned lower and relatively closer to the player than the middle row, wherein the longitudinal centerline of each of said lower row keys is aligned with the longitudinal centerline of a corresponding upper row key which produces the same note as said lower row key, wherein said lower row keys have a uniform width equal to the uniform width of the middle row keys, and wherein the frontmost ends of all said lower row keys are coplanar; and a nomographic music notation system comprising musical notation wherein notes to be played on one row of the keyboard are graphically marked while notes to be played on another row of the keyboard are unmarked, said notation system, in addition to conventional key signature symbols, including in the key signature area nomographic symbols indicating the lines and spaces on which said graphically marked notes occur.

2. A musical instruction system according to claim 1, wherein the graphic markings on certain notes and the nomographic markings in the key signature are alike.

3. The musical instruction system of claim 1, wherein notes are marked with a diagonal slant "/" through the body of the note.

4. The musical instruction system of claim 1, wherein the upper row $C^\#/D_\flat$ and $D^\#/E_\flat$ keys are graphically and tactilely differentiated from the remaining upper row keys by lengthening the upper row $C^\#/D_\flat$ and $D^\#/E_\flat$ keys so that from ends thereof are relatively closer to the player than front ends of the remaining upper row keys, and wherein the $F^\#/G_\flat$, $G^\#/A_\flat$, and $A^\#/B_\flat$ keys are graphically and tactilely differentiated from the remaining middle row keys by lengthening the $F^\#/G_\flat$, $G^\#/A_\flat$, and $A^\#/B_\flat$ keys so that front ends thereof are relatively closer to the player than front ends of the remaining middle row keys.

5. The musical instruction system of claim 1, wherein the upper row F and G keys are both graphically and tactilely differentiated from the remaining upper row keys by darkening the top and front surfaces of the upper row F and G keys, and by lengthening the upper row F and G keys so that front ends thereof are relatively closer to the player than front ends of the remaining upper row keys, and by beveling top surfaces and opposing side surfaces of the upper row F and G keys at the front ends thereof; and wherein the C keys are both graphically and tactilely differentiated from the remaining middle row keys by darkening the top and front surfaces thereof, and by lengthening and bevelling the front ends thereof, said F, G, and C keys thus tactilely providing a major scale index.

6. The musical instruction system of claim 5, wherein top surfaces of the upper row F and G keys are raised above top surfaces of the remaining upper row keys by about one-eighth inch (3 mm).

7. The musical instruction system of claim 5, wherein top surfaces of the C keys are raised above top surfaces of the remaining middle row keys by about one-eighth inch (3 mm).

8. The musical instruction system of claim 5, wherein the lower row F and G keys are graphically differentiated from the remaining lower row keys by darkening top and front surfaces of the lower row F and G keys.

9. The musical instruction system of claim 8, wherein top surfaces of the lower row F and G keys are raised above top surfaces of the remaining lower row keys by about one-eighth inch (3 mm).

10. A graphic/tactile musical instruction system, comprising:

tone producing means for producing a musical note in response to the actuation of a selected key of a keyboard;

a graphic/tactile keyboard wherein actuation of any two adjacent keys within a single row causes the tone producing means to produce two musical notes separated by a whole tone, and actuation of any two adjoining keys in adjacent rows produces two musical notes separated by a half-tone, the keyboard having:

an upper row of keys positioned relatively farther away from the player, the upper row keys producing the notes C#, D♭, D#/E♭, F, G, A and B, wherein adjacent upper row keys are separated by a gap, and wherein selected upper row keys are graphically and tactilely differentiated from the remaining upper row keys, the upper row keys in a predetermined one or more highest octaval groupings being narrower than the upper row keys in octaval groupings below said narrower keys;

a middle row of keys positioned lower and relatively closer to the player than the upper row, the middle row keys producing the notes C, D, E, F#/G♭, G#/A♭ and A#/B♭, wherein a longitudinal centerline of each middle row key is parallel to and laterally offset from the longitudinal centerline of an adjacent upper row key, and wherein the middle row keys have a uniform width approximately equal to the width of any selected one of the upper row keys plus the width of the gap separating the upper row key from an adjacent upper row key, and wherein selected middle row keys are graphically and tactilely differentiated from the remaining middle row keys; and a lower row of keys positioned lower and relatively closer to the player than the middle row, wherein the longitudinal centerline of each of said lower row keys is aligned with the longitudinal centerline of a corresponding upper row key which produces the same note as said lower row key, and wherein said lower row keys have a uniform width equal to the uniform width of the middle row keys, and wherein the frontmost ends of all said lower row keys are coplanar; and a nomographic music notation system comprising musical notation wherein notes to be played on one row of the keyboard are graphically marked while notes to be played on another row of the keyboard are unmarked, said notation system, in addition to conventional key signature symbols, including in the key signature area nomographic markings indicating the lines and spaces on which said graphically marked notes occur.

11. A graphic/tactile musical instruction system, comprising:

tone producing means for producing a musical note in response to the actuation of a selected key of a keyboard;

a graphic/tactile keyboard wherein actuation of any two adjacent keys within a single row causes the tone producing means to produce two musical notes separated by a whole tone, and actuation of any two adjacent keys in adjacent rows produces two musical notes separated by a half tone, said keyboard having an upper row of keys positioned relatively farther away from the player, said upper row keys producing the notes C#/D♭, D#/E♭, F, G, A and B, wherein adjacent upper row keys are separated by a gap, wherein front ends of the upper row C#/D♭ and D#/E♭ keys are relatively closer to the player than front ends of the upper row F, G, A and B keys, and wherein the upper row keys in a predetermined one or more of the lowest octaval groupings are wider than the remaining upper row keys, and wherein the gaps between said wider upper row keys are proportionately narrower than the gaps between the remaining upper row keys, a middle row of keys positioned lower and relatively closer to the player than the upper row, said middle row keys producing the notes C, D, E, F#/G♭, G#/A♭ and A#/B♭, wherein a longitudinal centerline of each middle row key is parallel to and laterally offset from the longitudinal centerline of an adjacent upper row key, and wherein said middle row keys have a uniform width approximately equal to the width of any selected one of the upper row keys plus the width of the gap separating said upper row key from an adjacent upper row key, and wherein front ends of the F#/G♭, G#/A♭, and A# keys are relatively closer to the player than front ends of the C, D and E keys, a lower row of keys positioned lower and relatively closer to the player than the middle row, wherein the longitudinal centerline of each of said lower row keys is aligned with the longitudinal centerline of a corresponding upper row key which produces the same note as said lower row key, and wherein said lower row keys have a uniform width equal to the uniform width of the middle row keys, and wherein front ends of the lower row keys are coplanar; and a nomographic music notation system comprising musical notation wherein notes to be played on one row of the keyboard are graphically marked while notes to be played on another row of the keyboard are unmarked, said notation system, in addition to conventional key signature symbols, including in the key signature area nomographic markings indicating the lines and spaces on which said graphically marked notes occur.

12. A musical keyboard comprising:

an upper row of keys positioned relatively farther away from the player, the upper row keys producing the notes C#/D♭, D#/E♭, F, G, A and B, wherein adjacent upper row keys are separated by a gap, and wherein the upper row F and G keys are graphically and tactilely differentiated apart from the remaining upper row keys, the upper row keys in a predetermined one or more highest octaval groupings being narrower than the upper row keys in octaval groupings below said narrower keys;

a middle row of keys positioned lower and relatively closer to the player than the upper row, the middle row keys producing the notes C, D, E, F#/G♭, G#/A♭ and A#/B♭, wherein a longitudinal centerline of each middle row key is parallel to and laterally offset from the longitudinal centerline of an adjacent upper row key, and wherein the middle row keys have a uniform width approximately equal to the width of any selected one of the upper row keys plus the width of the gap separating the upper row key from an adjacent upper row key, and wherein the C keys are graphically and tactilely differentiated from the remaining middle row keys; and a lower row of keys positioned lower and relatively closer to the player than the middle row, wherein the longitudinal centerline of each lower row key is aligned with the longitudinal centerline of a corresponding upper row key which produces the same note as the lower row key, and wherein the lower row keys have a uniform width equal to the uniform width of the middle row keys, and wherein the frontmost ends of all the lower row keys are coplanar.

13. A musical keyboard according to claim 12, wherein top and front surfaces of the upper row F and G keys are darkened, and wherein front ends of the upper row F and G keys are relatively closer to the player than front ends of the remaining upper row keys, and wherein top surfaces and opposite side surfaces of the upper row F and G keys are beveled toward their front ends.

14. A musical keyboard according to claim 12, wherein top surfaces of the upper row F and G keys are raised above top surfaces of the remaining upper row keys than about one-eighth inch (3 mm).

15. A musical keyboard according to claim 12, wherein top and front surfaces of the C keys are darkened, and wherein front ends of the C keys are relatively closer to the player than front ends of the remaining middle row keys.

16. A musical keyboard according to claim 12, wherein top surfaces of the C keys are raised above top surfaces of the remaining middle row keys about one-eighth inch (3 mm).

17. A musical keyboard according to claim 12, wherein the lower row F and G keys are graphically differentiated from the remaining lower row keys.

18. A musical keyboard according to claim 12, wherein top surfaces of the lower row F and G keys are raised about one-eighth inch (3 mm) above top surfaces of the remaining lower row keys.

* * * * *

UNITED STATES PATENT AND TRADEMARK OFFICE

CERTIFICATE OF CORRECTION

PATENT NO. : 4,926,734

DATED : May 22, 1990

INVENTOR(S) : James C. Rickey

It is certified that error appears in the above–identified patent and that said Letters Patent is hereby corrected as shown below:

At column 6, lines 18, 25, 27, 28, 48 and 65, at column 7, lines 6, 27, 32 and 48, and at column 10, line 23, in each instance, " "/" " should read --"\"--.

At column 8, line 67, delete "#" and insert --4 --.

At column 9, lines 9 and 20, in each instance, "0" should read --8--.

At column 12, line 26, "$A^{i}$" should read --$A^{i}/B_{i}$--.

Signed and Sealed this

Twenty-third Day of July, 1991

*Attest:*

HARRY F. MANBECK, JR.

*Attesting Officer*

*Commissioner of Patents and Trademarks*